United States Patent [19]

Lärkfeldt

[11] 3,946,647

[45] Mar. 30, 1976

[54] DEVICE FOR PREFERABLY COOLING A ROOM BY A VENTILATION AIR STREAM

[75] Inventor: Birger Lärkfeldt, Odensjo-Barnarp, Sweden

[73] Assignee: Aktiebolaget Svenska Flaktfabriken, Nacka, Sweden

[22] Filed: Apr. 22, 1974

[21] Appl. No.: 462,777

[30] Foreign Application Priority Data

May 7, 1973 Sweden ..... 7306409

[52] U.S. Cl. ..... 98/38 R; 98/40 N; 98/103

[51] Int. Cl.[2] ..... F24F 7/06; F24F 13/06

[58] Field of Search 98/110, 121 R, 121 A, 40 VM, 98/101, 3, 37, 39, 38 BZ, 40 N, 38 E; 239/423

[56] References Cited

UNITED STATES PATENTS

| | | | |
|---|---|---|---|
| 2,032,692 | 3/1936 | Foss | 98/36 |
| 2,443,071 | 6/1948 | Honerkamp et al. | 98/101 X |
| 2,911,035 | 11/1959 | Nieman et al. | 239/423 X |
| 2,936,693 | 5/1960 | Sweedyk | 98/110 |

FOREIGN PATENTS OR APPLICATIONS

| | | | |
|---|---|---|---|
| 123,587 | 12/1948 | Sweden | 98/103 |
| 509,549 | 8/1971 | Switzerland | 98/103 |

OTHER PUBLICATIONS

Air Mixing Box, M. B. Marton; IBM Technical Disclosure Bull., Vol. 13, No. 12, May, 1971, pp. 3693, 3694.

*Primary Examiner*—William F. O'Dea
*Assistant Examiner*—Ronald C. Capossela
*Attorney, Agent, or Firm*—Howson and Howson

[57] ABSTRACT

The throwing length of a stream of air entering a room through a large-area ventilator outlet is controllably increased by including within the aperture of the ventilator at least one air nozzle of adjustable direction and orifice cross-section and supplied with air under sufficiently high pressure to produce a high-velocity low-volume air jet directed into the room along the general direction of the main air stream.

7 Claims, 2 Drawing Figures

DEVICE FOR PREFERABLY COOLING A ROOM BY A VENTILATION AIR STREAM

Figure 1:
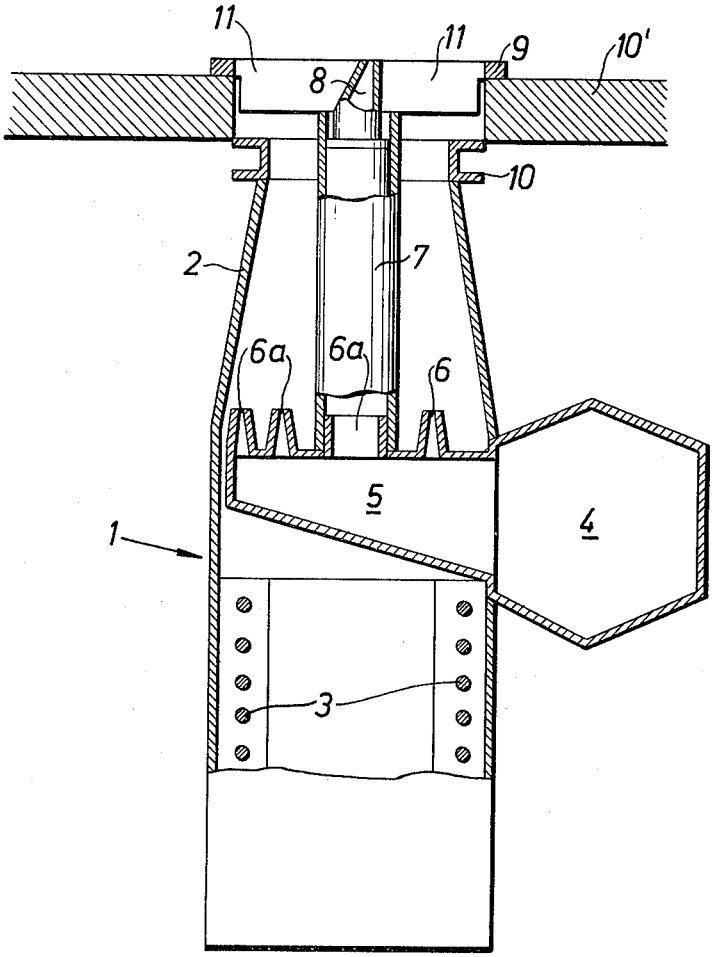

The present invention relates to a device, which is adapted, preferably in the cooling of a room by a ventilation air stream, to increase the throwing length of the air stream emitted from a supply air means located in said room, without producing a disturbing hissing noise.

In the cooling of a room, specially by means of a circulating ventilation air stream, there arises often the disadvantage of direct temperature drops within the living zones of persons who stay in these zones during relatively long periods of time for performing a work of sedentary kind and who, therefore, perceive the cold ventilation air stream as annoyingly inconvenient. The present invention had as its object to solve such problems of work environment which normally arise in office rooms, hotel premises and in many public rooms.

The invention is based on the understanding, that there exists a maximum ratio between supplied cooling effect and the impulse of the ventilation air for meeting certain comfort requirements in a defined living zone. The cooling effect being expressed as Q kcal/$h$ and the impulse as $q_p$ $m^3/h \times \Delta p$ mm wc; it was found that the following requirement is to be met for obtaining a sufficient throwing length and thereby a good comfort:

$$\frac{Q}{q_p \times \sqrt{\Delta p}} \leq 1$$

where $q_p$ designates the ventilation demand by supplied primary air from the central unit, $\Delta$ p is chosen with consideration paid to distribution, induction and sound. Q, as mentioned, designates the cooling demand. This demand is substantially totally dominated by the window/facade wall ratio, which may be as high as 0.6 – 0.7. It was found that, by known arrangements for the cooling of rooms by conventional installations, the above equation can render a value as high as about 3.0, which must be deemed unacceptable. The present invention has as its object to provide a solution of the aforesaid problems, with the observance that the total primary air flow need not be increased over the usual ventilation demand of about 25 $m^3/h$ per room module and, thus, the size of the central unit or duct system need not be increased. The invention further intends to provide the optimum solution of an acceptably low sound level and of non-rising operation costs.

The device according to the invention, which has proved to provide optimum cooling effect with the smallest possible size of central unit, at favourable operation costs and with a low sound level in the installation, is characterized in that one or more additional nozzles are mounted in or adjacent the outlet of the aforesaid supply air means, each adapted to supply a control air jet with a small flow in relation to said ventilation air stream.

A suitable embodiment is characterized in that the nozzles are connected to the same primary air channel as the supply air means. Another advantageous embodiment is characterized in that the nozzles are connected to a separate duct system for control air, and a further preferred embodiment is characterized in that the nozzles are adjustable to the ejection direction and/or outflow area.

Figure 2:
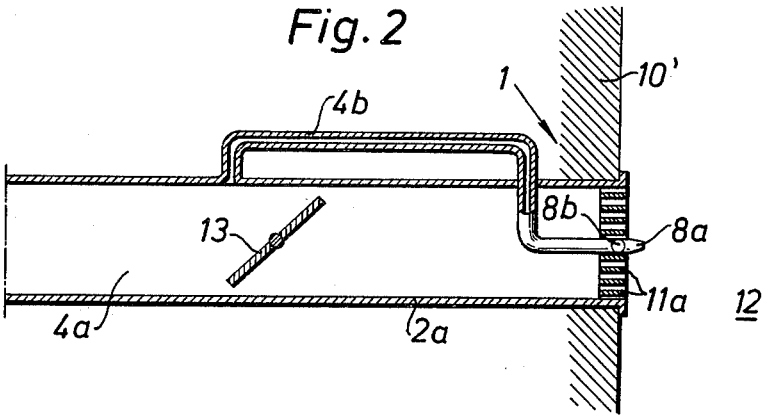

The invention is described in greater detail in the following, with reference to the accompanying drawing illustrating two embodiments by way of example, in which drawing FIG. 1 shows an embodiment with an induction apparatus as supply air means, and FIG. 2 shows another embodiment, with a supply air channel provided with throttle dampers and a supply air screen as supply air means.

In the drawing, 1 designates a supply air means in general. In FIG. 1, the designation 2 relates to a casing of an induction apparatus equipped with a heat exchanger 3. A distribution chamber for the primary air supplied from a central unit (not shown) is designated by 5 and connected to a primary air passageway 4. A number of nozzles 6 supply the primary air at a high rate to the upper portion of the casing 2 which in the embodiment shown is connected by flanges 10 to a window sill 10' and terminates with a screen 9, 11 for the ejection of the ventilation air stream to the room 12. 7 designates a pipe, which is placed above the nozzle **6*a* and, according to the invention, is terminated by one or more additional nozzles 8 mounted, for example, in one row one after the other along the centre line of the ejection screen of the induction apparatus 2.**

In FIG. 1 the nozzle is shown connected directly to the same primary air passageway 4 as the other nozzles 6 of the induction apparatus. In FIG. 2 another embodiment is shown, with the nozzle **8*a* connected before a damper for a supply air means 11a. The duct 4*b* is, for drawing-technical reasons, shown connected to the supply air passageway 4*a* in a point located closer to a central unit (not shown) than the schematically indicated throttle member 13. In FIG. 2 the screen has the designation 11*a*, and the casing of the supply air means has the designation 2*a*. As indicated in a schematic way by a joint 8*b*, the nozzle or nozzles are made adjustable to the ejection direction and/or outflow area, for example by movable blades of iris diaphragm type. A corresponding possibility of adjustability applies, of course, also to the nozzle or nozzles shown in FIG. 1.** The individual details in the embodiments shown can be modified within the scope of the attached claims.

I claim:

1. In a room air ventilating system comprising air outlet means for delivering a stream of air to a room and air supply means for supplying said stream of air to said air outlet means for passage therethrough into said room, the improvement wherein:

said air outlet means comprises main aperture means positioned substantially at a wall of said room for passing the majority of said stream into said room;

said system further comprises air nozzle means disposed adjacent said aperture means for delivering at least one jet of air into said room along the general direction of said majority of said stream, the cross-sectional area of the orifice of said nozzle means being small compared with the total cross-sectional area of said main aperture means and the outlet of said nozzle means to said room being positioned substantially at or slightly on the room side of said main aperture means; and said air supply means comprise a common source of air under pressure and first and second means separately connecting said main aperture means and said nozzle means respectively with said common source, said second means providing a smaller pressure drop than said first means such that the linear velocity of said at least one air jet from said nozzle means is large compared with the linear velocity of said air stream through said main aperture means while the volume rate of air flow through said nozzle means is small compared with that through said main aperture means, thereby to increase the throwing length of said stream of air into said room for any given total rate of air flow into the room.

2. The system of claim 1, in which said nozzle means are adjustable as to direction of air flow therefrom.

3. The system of claim 1, in which said nozzle means comprise at least one nozzle positioned within the perimeter of said main aperture means.

4. The system of claim 1, in which said nozzle means are adjustable as to cross-sectional area of orifice.

5. The system of claim 1, wherein said nozzle means are adjustable as to direction of air flow therefrom and as to cross-sectional area of orifice, and comprise at least one nozzle positioned within the perimeter of said main aperture means.

6. The system of claim 1, in which said first means connecting said main aperture means to said common source comprises an air chamber terminating at said main aperture means and a plurality of nozzles supplied with air from said common source and having their outlet ends in said chamber inwardly from said main aperture means.

7. The system of claim 1, in which said first connecting means comprises a duct containing a damper connected between said common source and said main aperture means, and said second connecting means comprises an air passage extending from said nozzle means to said common source for supplying air flow to said nozzle means by a path by-passing said damper.

* * * * *